United States Patent [19]

Eagle

[11] 4,104,830

[45] Aug. 8, 1978

[54] ADJUSTABLE THRESHOLD

[76] Inventor: Fred Eagle, 905 W. 93rd Ter., Kansas City, Mo. 64114

[21] Appl. No.: 814,531

[22] Filed: Jul. 11, 1977

[51] Int. Cl.[2] ..... E06B 1/70

[52] U.S. Cl. ..... 49/468; 49/469

[58] Field of Search ..... 49/468, 469, 467

[56] References Cited

U.S. PATENT DOCUMENTS

| | | | |
|---|---|---|---|
| 1,595,827 | 8/1926 | Frisque | 49/208 X |
| 2,794,219 | 6/1957 | Macklanburg | 49/469 |
| 2,947,043 | 8/1960 | Klemma | 49/469 X |
| 3,501,866 | 3/1970 | Johnson | 49/468 X |
| 3,900.967 | 8/1975 | Bursk et al. | 49/468 |

*Primary Examiner*—Philp C. Kannan

*Attorney, Agent, or Firm*—Fishburn, Gold & Litman

[57] ABSTRACT

An adjustable threshold assembly includes a base member having a central groove for receiving an inverted U-shaped channel threshold member, which is supported by a plurality of wedge sets spaced at regular intervals and each consisting of a fixed bottom wedge and a top wedge removably fastened to the web of the threshold member by passage of a screw through a slot in the web. Height adjustment is provided by lateral translation of the top wedges in cooperation with the corresponding fixed bottom wedge. The threshold member includes a resilient door engaging cushion strip overlying the web and covering the screws and slots therein.

8 Claims, 5 Drawing Figures

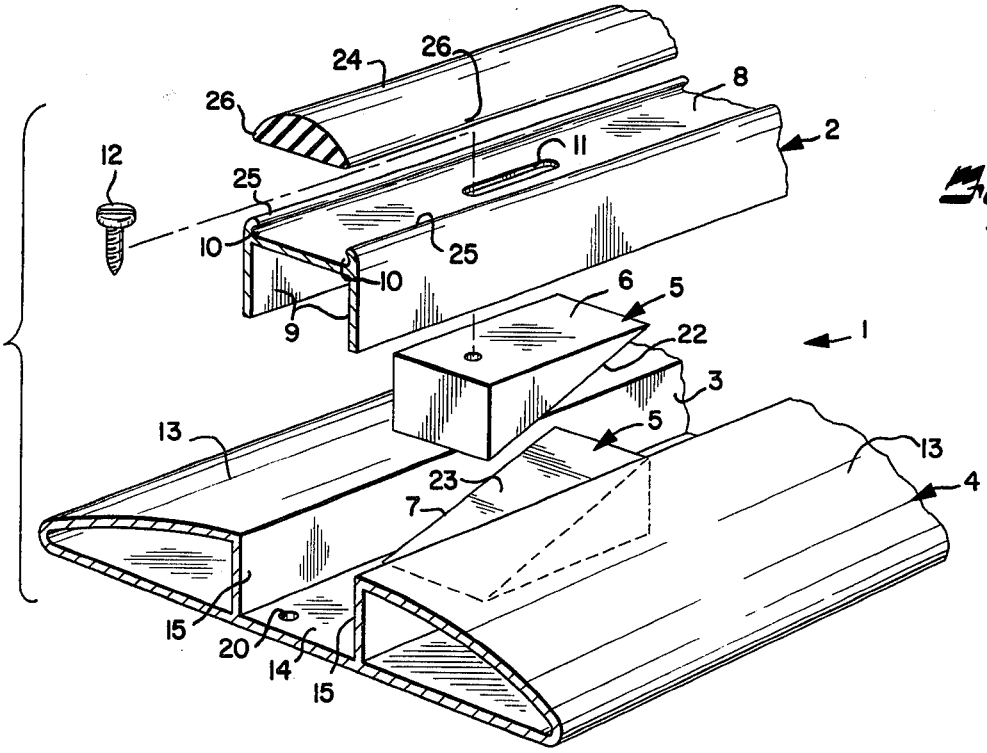
Fig. 1.
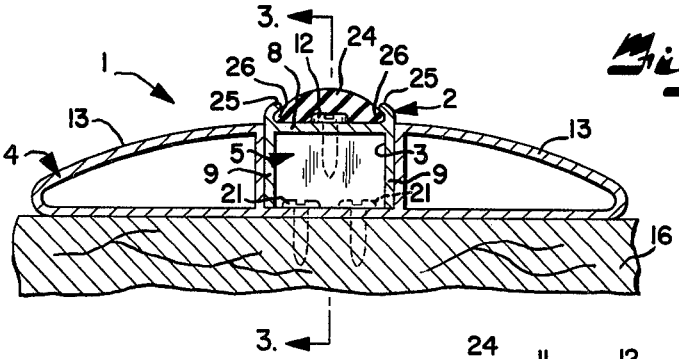
Fig. 2.
Fig. 3.
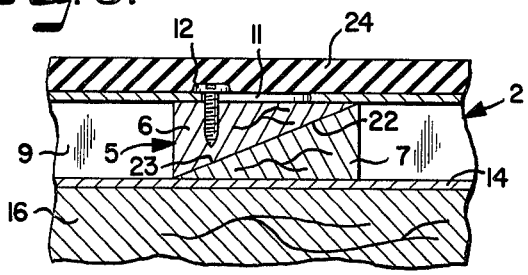
Fig. 4.
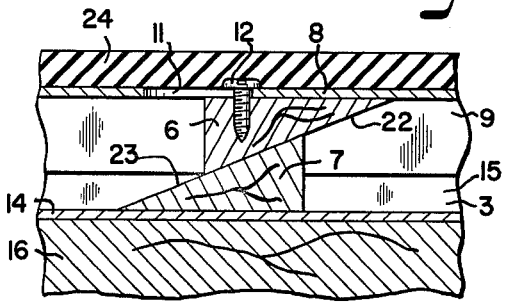
Fig. 5.
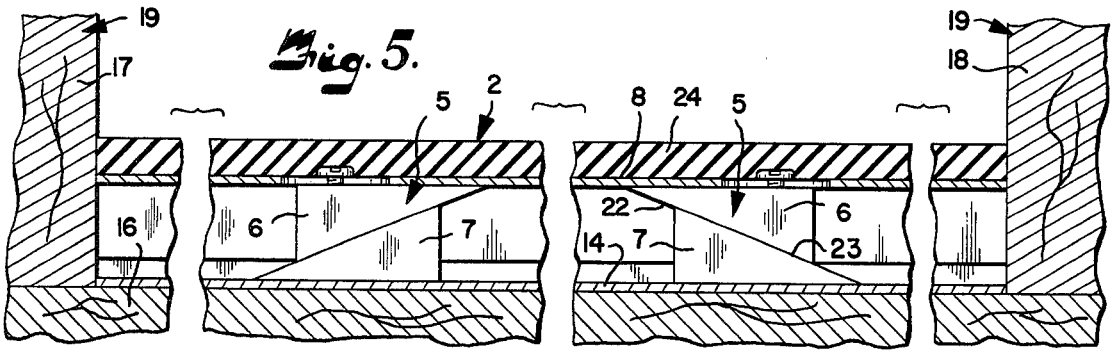

ADJUSTABLE THRESHOLD

The present invention relates to adjustable thresholds and more particularly to such a threshold employing a movable and fixed members having engaging inclined surfaces as an adjustment mechanism.

Thresholds are necessary devices especially on outside doors for providing seals against drafts and rain. In general, the dimensions of a door and its frame are not entirely stable due to expansion and contraction caused by seasonal changes, namely swelling by moisture absorption or shrinkage from drying out, and sagging caused by hinge wear or general settling of a building. Also, imprecise manufacture of a door or installation thereof can result in binding or gaps between the door and mating surfaces. In order to alleviate fitting problems between a door and its threshold, it is desirable for the threshold to be adjustable in height.

The methods of adjustment in prior designs for such thresholds generally involve substantial labor due to partial disassembly and trial and error to obtain suitable results in height change. In many cases, screws which are turned for adjustment also support whatever load the threshold is required to support, such as dollies carrying appliances passing thereover. Stress is thereby concentrated in limited areas of the threshold structure. Such an arrangement runs counter to good design principles and such loading can alter the engagement and seal between the door and threshold.

In the adjustable threshold of the present invention, a movable threshold member is supported on a threshold base by sets of members having engaged inclined surfaces such as wedge sets forming blocks at selected intervals. Load on the threshold is better distributed. Height adjustment is made by loosening a fastener mounting a movable inclined member, translating that member relative to a fixed inclined member until desired height of the threshold is reached, and retightening the fastener. Further, any tendency of the threshold member to slide laterally is resisted by alternating the orientation of the inclined surfaces of the sets.

The principal objects of the present invention are: to provide an improved threshold that is adjustable in height; to provide such an adjustable threshold that is easily installed in new or existing buildings; to provide such an adjustable threshold the height of which is easily and readily adjusted; to provide such an adjustable threshold comprising a threshold member supported on a threshold base by wedge sets forming blocks; to provide such an adjustable threshold wherein vertical loads imposed thereon are evenly distributed; to provide such an adjustable threshold wherein the needed height adjustment is measured and is made by selective relative positioning of the movable inclined member of a set in relation to the fixed inclined member to obtain the premeasured height change desired thereof; to provide such an adjustable threshold in which longitudinal movement of the threshold member in relation to the base member is resisted by alternate orientation of the inclined member sets; and to provide such an adjustable threshold which is economical to manufacture, attractive in appearance, durable in construction, and which is particularly well adapted for its intended purpose.

Other objects and advantages of this invention will become apparent from the following description taken in connection with the accompanying drawings wherein are set forth, by way of illustration and example, certain embodiments of the present invention.

The drawings constitute a part of this specification, include an exemplary embodiment of the adjustable threshold, and illustrate various objects and features thereof.

FIG. 1 is a fragmentary exploded perspective view of the adjustable threshold.

FIG. 2 is a transverse sectional view of the adjustable threshold.

FIG. 3 is a fragmentary longitudinal sectional view taken on line 3—3, of FIG. 2 and showing the threshold member at its lowest position in relation to the threshold base.

FIG. 4 is a view similar to FIG. 3 showing the threshold member in a raised position.

FIG. 5 is a fragmentary longitudinal sectional view of the adjustable threshold showing the alternate orientation of succeeding wedge sets.

As required, detailed embodiments of the present invention are disclosed herein. However, it is to be understood that the disclosed embodiments are merely exemplary of the invention which may be embodied in various forms. Therefore, specific structural and functional details disclosed herein are not to be interpreted as limiting but merely as a basis for the claims and as a representative basis for teaching one skilled in the art to variously employ the present invention in virtually any appropriately detailed structure.

Referring to the drawings in more detail:

The reference numeral 1 generally designates an adjustable threshold assembly comprising generally an elongated threshold member 2 mounted in a longitudinal groove 3 of an elongated threshold base 4. The threshold member 2 is supported on the threshold base 4 by a plurality of adjustment member sets 5 selectively and longitudinally spaced along the threshold base. Each adjustment member set 5 consists of a top adjustment member 6 and a bottom adjustment member 7 with one fixed to the threshold base 4 and the other adjustably fastened to the threshold member 2.

In the illustrated structure the threshold member 2 is an elongated inverted channel-shaped member having a web 8 and having a flange 9 depending from each side edge 10 of the web 8. The web 8 has a plurality of fastener receiving slots 11 spaced along the length thereof. The slot 11 is adapted to receive a fastener or screw 12 passed therethrough to removably attach the top adjustment members 6 to the threshold member 2.

The threshold base 4 has a groove 3 and in the illustrated structure the groove 3 is centrally located and there is a ramped approach portion 13 on either side thereof. The groove 3 includes a bottom wall 14 and spaced apart side walls 15. The threshold base 4 is adapted for mounting on a support floor 16 extending between the side members 17 and 18 (FIG. 5) of a door frame 19. The bottom wall 14 of the groove 3 includes a plurality of apertures 20 spaced therealong to receive suitable fasteners such as screws 21 or the like for attaching the threshold base 4 to the support floor 16. In the illustrated structure the adjustment members are wedges and the bottom wedges 7 are fixed to the bottom wall 14 at locations to register with the top wedges 6 when the threshold member 2 is installed in the groove 3.

The wedges of a set having mating inclined surfaces and as illustrated the top wedge 6 includes an inclined lower surface 22 while the bottom wedge 7 includes an inclined upper surface 23. In operative position, the top wedge 6 rests on the bottom wedge 7, with the inclined surface 22 of the top wedge engaging the inclined surface 23 of the bottom wedge 7. While the wedge sets 5 may be oriented in any position about a vertical axis thereof, it is preferable for the wedge set 5 to be oriented with the inclined surfaces 22 and 23 tilted toward the side members 17 and 18 of the door frame 19 rather than toward the side walls 15 of the central groove 3. Likewise, it is preferable that certain sets have the inclined faces opposite those of other sets to limit relative longitudinal movement of the threshold member 2 and threshold base 4. It is also preferable for the longitudinal axis of the slots 11 to be parallel with the longitudinal axis of the threshold member 2 for reasons that will become more apparent hereinbelow.

With reference to FIGS. 3 and 4, adjustments in the height of the threshold member 2 above the threshold base 4 is accomplished generally by displacement of the top wedge 6 relative to the bottom wedge 7. It is first necessary to loosen the screw 12 from the top wedge 6, after which the top wedge 6 is free to move to a degree limited only by the length of the slot 11. It is apparent that as the top wedge 6 is moved longitudinally of the threshold member 2, the top wedge 6 must move up the inclined surface 23 of the bottom wedge 7. The increase in altitude of the top wedge 6 is transferred to the threshold member 2 supported thereby. When the desired height is reached, the screw 12 is retightened into the top wedge 6. It can be seen that lowering the threshold member 2 may be accomplished by reversing the procedure until the lowest position of the top wedge 6 is reached whereby the inclined surface 22 comes into contact with the bottom wall 14 of the threshold base 4.

The angle of inclination of the inclined surfaces 22 and 23 is selected for best support and desired height change for a given lateral displacement of the top wedge 6. The optimum angle of inclination of the inclined surfaces 22 and 23 is found to lie between about 15° and 30° from horizontal.

The threshold base 4 may be constructed from any suitable materials such as shaped wood, molded plastic, or, preferably, an extruded metal such as aluminum or brass. The threshold member 2 is formed of suitable material such as wood, plastic or preferably an extruded metal such as aluminum or brass for reasons of economy and strength. The wedges 6 and 7 may be formed of wood, plastic, metal, or other suitable material having similar structural applications.

The adjustable threshold 1 includes an elongated resilient strip 24 mounted in overlying relationship thereto. In the illustrated structure the threshold member 2 includes an upwardly and inwardly turned rim 25 formed along each side edge 10 of the web 8. The resilient strip 24 is in overlying relation to the web 8 with side edges 26 of the resilient strip 24 received under the rims 25 of the threshold member 2. The resilient strip 24 provides a cover for the screws 12 to prevent tampering therewith and gives the adjustable threshold 1 a finished appearance. The resilient strip 24 provides for a resilient engagement between a door (not shown) and the threshold member 2, and provides a more effective seal therebetween.

The adjustable threshold 1 is normally assembled with several wedge sets 5 distributed along the length thereof. It has been found that one wedge set 5 for each foot of length of the threshold provides adequate support for the threshold member 2, with a minimum of two wedge sets 5 in any threshold 1. With reference to FIG. 5, it can be seen that the direction of inclination of the inclined surfaces 22 and 23 preferably is alternated from wedge set to succeeding wedge set. The alteration of the direction of inclination resists any tendencies of the threshold member 2 to slide longitudinally, that is, towards the ends thereof as would happen if the inclined surfaces were all tilted in the same direction. This alteration provides opposed forces that maintain the selected position of the threshold member 2. The threshold member 2 is sized to fit snugly in the groove 3 with the flanges 9 in contact with the side walls 15 of the groove 3 in order to minimize play between the threshold member 2 and the threshold base 4, to prevent the threshold member 2 from accidently being knocked out of the groove 3, and to further minimize tampering with the threshold 1.

Summarizing the adjustment procedure, it is first ascertained which portion of the adjustable threshold 1 requires adjustment, then the resilient strip 24 is removed. At each wedge set 5 that requires adjustment, the screw 12 is loosened just enough to allow the top wedge 6 to slide. A suitable scale may be provided whereby it is indicated that a certain longitudinal movement of the top wedge 6 will provide a certain height change at that wedge set. Then the top wedge 6 is moved toward one end or the other depending on whether raising or lowering is desired. The top wedge 6 may be moved either by grasping the head of the screw 12 or by tapping the side of the head of the screw 12. Then the screw 12 is retightened. In raising a wedge set, it may be necessary to lift the threshold member 2 slightly to reduce frictional resistance between the inclined surface 22 and 23. When all of the required wedge sets 5 have been adjusted, the threshold member 2 is tested to make sure that the top and bottom wedges 6 and 7 of each set are in contact. The door (not shown) may then be closed over the threshold 1 to determine if the adjustment is adequate. If so, the resilient strip 24 is replaced. The resilient strip 24 allows for some tolerance of fit between the door and the threshold member 2.

While certain forms of the present invention have been described and illustrated, it is not to be limited thereto except insofar as such limitations are included in the following claims.

What I claim and desire to secure by Letters Patent is:

1. An adjustable threshold assembly, for use in a doorway having a threshold support base extending between a pair of door frame members, said threshold assembly comprising:

(a) an elongated threshold member having a horizontal wall, said threshold member mounted on said threshold support base;

(b) said threshold member wall having a lower surface and having a fastener receiving slot formed therein;

(c) a loosenable fastener;

(d) a top block having an inclined lower surface, said top block being removably and adjustably fastened to the lower surface of said threshold member wall by receiving said fastener through said slot; and (e) a bottom block having an inclined upper surface of substantially equal inclination to said top block lower surface, said bottom block being fixed to said threshold support base with said bottom block upper inclined surface abutting said top block lower inclined surface, whereby horizontal translation of said top block varies the height of said threshold member relative to said threshold support base.

2. An adjustable threshold assembly as set forth in claim 1 including:

(a) a plurality of said slots longitudinally spaced along said threshold member wall; and (b) a set of said top block and said bottom block associated with each of said plurality of slots.

3. An adjustable threshold assembly as set forth in claim 1 wherein:

(a) said slot is oriented with the longitudinal axis thereof parallel to the longitudinal axis of said threshold member; and (b) said bottom block upper inclined surface is inclined toward one of said door frame members whereby the height of said threshold member relative to said threshold support base is varied by translation of said top block in a direction parallel to the longitudinal axis of said threshold member.

4. An adjustable threshold as set forth in claim 3 including a plurality of sets of said slot and said top and bottom blocks wherein the inclined surfaces of succeeding sets of said top block and said bottom block alternate between a direction toward one of said door frame members and a direction toward the other of said door frame members.

5. An adjustable threshold as set forth in claim 1 wherein:

(a) said threshold support base comprises an elongated base member having a central groove with a bottom wall and spaced apart side walls, said base member including ramped approach portions on each side of said groove;

(b) said bottom block is fixed to said base member groove bottom wall;

(c) said threshold body is elongated and channel shaped including a web having an upper and a lower surface and side edges and having said slot formed therein, said threshold body including a pair of spaced apart flanges depending from said web lower surface side edges;

(d) said top block is removably fastened to said web lower surface; and (e) said threshold body is received in said groove with said flanges in close proximity to respective groove side walls.

6. An adjustable threshold as set forth in claim 5 including:

(a) an upwardly and inwardly directed rim formed along each of said web upper surface side edges; and (b) an elongated resilient strip having side edges thereof received under said rims, said strip overlying said web upper surface.

7. An adjustable threshold assembly, for use in a doorway between a pair of door frame members, comprising:

(a) an elongated base having an elongated channel receiving groove, said groove having a bottom wall and spaced apart side walls;

(b) an elongated channel member having a web with an upper and lower surface, side edges, and a pair of spaced apart flanges depending from said lower surface side edges, said web having longitudinally spaced fastener receiving slots, each slot having a longitudinal axis;

(c) said channel member being received in said groove with said channel member flanges in close proximity to respective base side walls;

(d) a set of wedges associated with each of said slots, each wedge set comprising a top wedge having an inclined lower surface and a bottom wedge having a similarly inclined upper surface;

(e) one of said bottom wedges being fixed to said base bottom wall below each of said slots with the inclined upper surface of each bottom wedge being inclined toward one of said door frame members; and (f) a loosenable fastener passing through each of said slots to removably fasten a respective top wedge to said web lower surface, each of said top wedges being oriented for abutment of the inclined lower surface thereof with the upper inclined surface of its respective bottom wedge.

8. An adjustable threshold assembly set forth in claim 7 wherein:

(a) the longitudinal axes of said slots are parallel to the longitudinal axis of said channel member; and (b) the upper inclined surface of succeeding bottom wedges alternate between a direction toward one of said door frame members and a direction toward the other of said door frame members.

* * * * *